United States Patent [19]

Durand et al.

[11] Patent Number: 4,747,964

[45] Date of Patent: May 31, 1988

[54] DISPERSING ADDITIVE COMPOSITIONS FOR LUBRICATING OILS AND THEIR MANUFACTURE

[75] Inventors: Jean-Pierre Durand, Chatou; Daniel Binet; Guy Parc, both of Rueil-Malmaison, all of France

[73] Assignee: Institut Francais du Petrole, Rueil-Malmaison, France

[21] Appl. No.: 896,372

[22] Filed: Aug. 14, 1986

[30] Foreign Application Priority Data

Aug. 14, 1985 [FR] France ..... 85 12482

[51] Int. Cl.[4] ..... C10M 133/44

[52] U.S. Cl. ..... 252/51.5 A; 548/545

[58] Field of Search ..... 252/51.5 A; 548/545

[56] References Cited

U.S. PATENT DOCUMENTS

| | | | |
|---|---|---|---|
| 3,184,474 | 5/1965 | Catto | 252/51.5 A |
| 4,094,802 | 6/1978 | Soula et al. | 252/51.5 A |
| 4,234,435 | 11/1980 | Meinhardt et al. | 252/47.5 |
| 4,401,581 | 8/1983 | Barrons et al. | 252/51.5 A |
| 4,428,849 | 1/1984 | Wisutsky | 252/51.5 A |
| 4,482,464 | 11/1984 | Karol et al. | 252/51.5 R |
| 4,617,137 | 10/1986 | Plavac | 252/51.5 A |
| 4,617,138 | 10/1986 | Wollenberg | 252/51.5 A |

FOREIGN PATENT DOCUMENTS 0072645 2/1983 European Pat. Off. .

OTHER PUBLICATIONS

CA 86:(12)75738f.

*Primary Examiner*—Jacqueline V. Howard
*Attorney, Agent, or Firm*—Millen & White

[57] ABSTRACT

New dispersing additive compositions for lubricating oils, an object of the invention, have an improved efficiency.

Said compositions may be either (1) the products obtained by reacting alkenylsuccinimides with aromatic dianhydrides, or (2) the products obtained by reacting alkenylsuccinimides with an anhydride or a dianhydride of mono- or poly-carboxylic aliphatic, alicyclic or aromatic acid of low molecular weight, the obtained product being then reacted with at least one organic compound having several hydroxyl and/or amine groups.

These dispersing additive compositions may be added to lubricating oils in a proportion, for example, from 0.1 to 20% by weight.

21 Claims, No Drawings

DISPERSING ADDITIVE COMPOSITIONS FOR LUBRICATING OILS AND THEIR MANUFACTURE

The invention concerns dispersing compositions for lubricating oils having an improved efficiency. More particularly, the invention concerns new dispersing compositions soluble in lubricating oils, obtained either (1) by reacting polyamines alkenylsuccinimides with certain dianhydrides, or (2) by reacting polyamines alkenylsuccinimides with an anhydride or a dianhydride of mono- or poly-carboxylic, aliphatic, alicyclic or aromatic acid of low molecular weight, the obtained product being then reacted with at least one organic compound having several hydroxyl and/or amine groups.

BACKGROUND OF THE INVENTION

One of the main problems presently encountered in engine lubrication is due to the unavoidable presence in the lubricant of suspended extraneous particles such as carbonaceous matter and sludge originating from soot, products resulting from the deterioration of the motor-fuel and of the lubricant, and water.

The accumulation of these suspended matters raises a serious problem for lubricant efficiency in the engine and it is important to prevent the agglomeration and the deposition of these undesirable matters, as varnishes, hard carbonaceous matters and sludge, on the different parts of the engine. Since many years, attempts have been made to avoid these difficulties by using organo-metallic additives, such for example as sulfonates, phenolates or salicylates of alkaline-earth metals, or organic additives such for example as polymethacrylates, either grafted or copolymerized with nitrogen-containing monomers, or polyethylene-polyamine alkenylsuccinimides, or even polyol alkenylsuccinates.

However the use of organo-metallic additives is limited by the risk of deposition of various metal oxides on the spark plugs of spark-ignition engines; the deposits formed produce a pre-ignition detrimental to the engines. The known ashless organic additives suffer from the disadvantage of a limited efficiency at high temperature and also sometimes in the presence of water traces.

The European patent application EP-A-No. 72 645 discloses dispersing additives for lubricating oils prepared by a process comprising:

(1) reacting a polyalkenylsuccinic anhydride (for example polyisobutenylsuccinic anhydride whose polyisobutenyl chain has an average molecular weight by number from 900 to 2000) with an alkylene polyamine, and then (2) reacting the product from step (1) with an anhydride of dicarboxylic acid such as maleic anhydride, succinic anhydride and alkyl- and alkenyl-succinic anhydrides having from 1 to 18 carbon atoms in the alkyl or alkenyl chain.

SUMMARY OF THE INVENTION

The invention has as an object the provision of new additive compositions for lubricating oils said compositions having improved properties, particularly a higher dispersing efficiency and an increased thermal stability.

Generally, the additive compositions according to the invention may be defined either as products (1) resulting from the reaction of at least one polyamine alkenylsuccinimide with at least one dianhydride of an aromatic tetracarboxylic acid of low molecular weight, or as products (2) resulting from the reaction of at least one polyamine alkenylsuccinimide with at least one anhydride or dianhydride of mono- or polycarboxylic, aliphatic, alicyclic or aromatic acid of low molecular weight, followed by the reaction of the resultant product with at least one organic compound having several hydroxyl and/or amine groups such as hereinafter defined.

More particularly, the polyamine alkenylsuccinimides used to prepare the additives according to the invention are obtained by reacting various polyamines with an alkenylsuccinic anhydride wherein the alkenyl group is derived from a polymer of a monoolefin containing 2 to 5 carbon atoms (more particularly polyisobutene) wherein the alkenyl (e.g. polyisobutenyl) group has an average molecular weight by number ($\overline{Mn}$) from 500 to 5000, preferably from 800 to 1500.

The polyamines which are convenient for the preparation of the alkenylsuccinimides according to the invention are more particularly those complying with the general formula:

$$H_2N\ CH_2\ CH_2—(—NH\ CH_2\ CH_2—)—_m\ NH_2$$

wherein m is zero or an integer from 1 to 10. These bi-primary polyamines may for example be ethylenediamine or polyethylenepolyamines such as diethylenetriamine, tetraethylenepentamine, pentaethylenehexamine or even mixtures of these polyamines as available on the market.

The alkenylsuccinic anhydride and the polyamine (as above defined) are reacted in a known manner by using, for example, a proportion of alkenylsuccinic anhydride from about 1 to 2 moles per mole of bi-primary polyamine.

The preparation of additive compositions according to the invention, either products (1) or (2), always comprises a step (a) wherein at least one alkenylsuccinimide such as above defined is reacted with at least one anhydride or dianhydride of mono- or poly-carboxylic, aliphatic, alicyclic or aromatic acid of low molecular weight, for example at most about 250. Examples of anhydrides and dianhydrides which can be used for manufacture products (2) are anhydrides of monocarboxylic acids such as acetic and butyric anhydrides and anhydrides of polycarboxylic acids, such as maleic and succinic anhydrides or pyromellitic dianhydride. Pyromellitic dianhydride is essentially used for manufacturing the products (1).

The reaction involved in step (a) is performed by admixing the above-defined reactants in proportions generally corresponding to a molar ratio "alkenylsuccinimide/anhydride" from 0.25/1 to 20/1, preferably from 0.5/1 to 10/1. The operating temperature may range from 20° to 200° C. For example the reaction may begin at relatively low temperature (e.g. 20° to 50° C.) and end at a higher temperature, for example about 130°-180° C.

The reaction is most often conducted with e.g., a solvent, a mineral oil such as 100 Neutral oil, for example in such a proportion that the final product contains from 50 to 70% by weight of active matter.

Sometimes, a certain amount of aromatic solvent, for example xylene or toluene, is also used. Then, the operation is conducted at reflux of the aromatic solvent. This solvent may be removed at the end of the reaction by heating the reaction mixture, for example under reduced pressure.

The reaction is complex but it may be assumed that several reactions between the anhydride and the primary and secondary amine groups of the alkenylsuccinimide are superposed. Depending on the operating conditions and particularly on the nature of the anhydride and on the molar ratio "anhydride/alkenylsuccinimide", there is obtained an increase of the molecular weight, a decrease of the TBN (Total Basic Number) and an increase of the TAN (Total Acid Number).

For manufacturing products (2), the products obtained in step (a) are then reacted, in a second step (b), with at least one organic compound having several hydroxyl and/or amine groups, more particularly selected from the following classes:

aliphatic polyols, preferably containing 3 to 6 hydroxyl groups, such for example as trimethylolpropane, pentaerythritol or dipentaerythritol;

aliphatic aminoalcohols, preferably containing one primary amine group and 1 to 3 hydroxyl groups, such for example as 2-amino 2-methyl propanol or tris-hydroxymethyl aminomethane;

polyamines of the general formula $H_2N\ CH_2\ CH_2$-(NH $CH_2\ CH_2)_m$ $NH_2$ as above defined ; and esters with free hydroxyl groups formed by reaction of an alkenylsuccinic anhydride with a polyol, such for example as the poly-isobutenylsuccinates of trimethylolpropane, pentaerythritol and dipentaerythritol.

The reaction involved in the second step (b) is performed by admixing the above-defined reactants in proportions generally corresponding to a molar ratio "organic compound/anhydride" from 0.25/1 to 4/1, preferably from 0.5/1 to 2/1.

The operating temperature may range from 100° to 200° C. and is preferably of about 150° C. The reaction is mostly conducted in the same solvent as in step (a), generally a mineral oil, for example a 100 Neutral oil.

Generally, the additive compositions according to the invention may be used alone in lubricants or in combination with other conventional additives. As dispersing additives in oils, they may be used in proportion from 0.1 to 20% by weight of the lubricant, according to the use for which the lubricant is designed and according to the presence or absence of other additives, especially of dispersing agents and/or detergents. Usually, their proportion may vary from 1 to 10% by weight of the lubricant. The compositions according to the invention may be incorporated with various mineral, synthetic or mixed base oils, used for various purposes such as lubricants for spark-ignition engines or compression-ignition engines (as for example, in cars or trucks engines, two-stroke engines, reciprocating aircraft engines, ship-engines or even railway Diesels). Moreover, automatic transmission fluids, gear fluids, metal-working fluids, hydraulic fluids and greases may also be improved by incorporation of the additives according to the invention.

Normally, the compositions according to the invention are used in admixture with other conventional additives. The latter comprise phosphorus or sulfur products improving the extreme-pressure properties, organo-metallic detergents such as phenolate-sulfides, sulfonates and salicylates of alkaline-earth metals, ashless dispersing agents, thickening polymers as well as antifreezing agents, oxidation inhibitors, anticorrosive, antirust and antifoam agents, etc....

EXAMPLES

The following examples are given to illustrate the invention but must not be considered as limiting the scope thereof. Examples 1,3,5,7 and 9 are given for comparison purpose.

In these examples, the mixtures of polyisobutenylsuccinimides A, B and C are derived from polyisobutenyl-succinic anhydride whose polyisobutenyl group has a number average molecular weight of about 920.

EXAMPLE 1 (comparative)

2.2 g ($2.2\times10^{-2}$ mole) of maleic anhydride and 65 g of xylene are added to 102 g of a mixture A containing 39 g of 100 Neutral oil and 63 g of a polyisobutenyl-succinimide obtained by reacting polyisobutenyl-succinic anhydride with a commercial mixture of tetraethylenepentamine (TEPA) (in a molar ratio "anhydride/-TEPA" of 1.5). The reaction mixture is stirred for 4 hours at room temperature, then xylene is removed by distillation under reduced pressure.

The reaction mixture is added in a proportion of 3% by weight of active materials to an additive-containing mineral oil free of ashless dispersing additive. The dispersing efficiency of the composition according to the invention is estimated by the "spot test" on filter-paper, in the presence of carbonaceous matter from a Diesel engine used oil. The ratio between the diameter of the black spot and that of the oil aureola is determined after 48 hours, the mixture having undergone different treatments before deposition on the filter paper. The conditions of the spot test and the results obtained are summarized in table I. This table also reports the results obtained under the same conditions with the additive-containing oil in the absence of ashless dispersing additive (mixture 0) and with the above-defined mixture A.

A product prepared in the conditions of example 1 is included as an ashless dispersing agent at a concentration of 3% by weight of active matters in a lubricating oil formulation of SF/CD level and subjected to a motor test of V-D sequence type in order to evaluate the protection against muds, varnishes and wear. This test, conducted in accordance with Standard ASTM 315 - Part III, is performed with a Ford gasoline engine of 4 cylinders.

The results of this motor test (marks : average piston varnish, average engine varnish and average muds) are summarized in Table II (1).

On the other hand, a product prepared in the conditions of example 1 is included, as an ashless dispersing agent, at a concentration of 3% by weight of active matters in a monograde SAE 30 lubricating oil and subjected to a motor test MWM (B). The results of this motor test are summarized in Table II (2).

EXAMPLE 2

2.2 g (2.2 $10^{-2}$ mole) of maleic anhydride and 64 g of xylene are added to 102 g of mixture A, defined in example 1. The reaction mixture is stirred for 3 hours at 30° C. To the so-obtained reaction mixture, are added 2.78 g ($2.3\times10^{-2}$ mole) of tris-hydroxymethylaminomethane and 0.11 g of zinc acetate as a catalyst. The resultant mixture is stirred at 30° C. for 30 minutes, then heated at xylene reflux for 6 hours. The reaction mixture is freed of xylene by distillation under reduced pressure and then 19.2 g of 100 Neutral oil are added thereto and it is filtered. The dispersing efficiency, evaluated in the same manner as in example 1, is shown by the results reported in Table I.

A product prepared in the conditions of example 2 is included as an ashless dispersing agent at a concentration of 3% by weight of active matters in the lubricating oil formulation of SF/CD level of example 1 and subjected to a motor test of the V-D sequence type. The results of said motor test, shown in Table II (1) illustrate the improvement obtained by the additive of example 2 as compared with the product of comparative example 1. Table II (2) also reports the result of motor test MWM (B) conducted under the conditions described in example 1, but with the use, as the ashless dispersing additive, of the additive of example 2. The result also shows the improvement obtained by replacing the additive of the comparative example 1 by that of example 2.

EXAMPLE 3 (comparative)

3.7 g (3.8 $10^{-2}$ mole) of maleic anhydride and 70 g of xylene are added to 85 g of mixture A, defined in example 1. The reaction mixture is heated for 5 hours at reflux, then xylene is removed by distillation under reduced pressure. The results of the dispersing efficiency tests of said mixture are indicated in Table I. Table II summarizes the results of motor tests with the product of said example.

EXAMPLE 4

3.7 g ($3.8\times10^{-2}$ mole) of maleic anhydride and 70 g of xylene are added to 85 g of mixture A, defined in example 1. The reaction mixture is heated for 5 hours at reflux ; then xylene is removed by distillation under reduced pressure. 1.54 g (about $1.15\times10^{-2}$ mole) of trimethylolpropane is added to the reaction mixture. The mixture is then maintained at 150° C. for 6 hours.

The excellent dispersing efficiency of the resultant product is illustrated by the results reported in table I. On the other hand, the results of the V-D sequence and MWM (B) motor tests reported in Table II show the improvement resulting from the replacement of the product of example 3 by that of example 4.

EXAMPLE 5 (comparative)

1.05 g (about $10^{-2}$ mole) of maleic anhydride and 70 g of xylene are added to 95 g of a mixture B containing 37 g of 100 Neutral oil and 58 g of a polyisobutenyl-succinimide obtained by reacting polyisobutenyl-succinic anhydride with a commercial mixture of tetraethylenepentamine (molar ratio "anhydride/TEPA" of 2). The reaction mixture is heated for 2.5 hours at reflux and xylene is then removed by distillation under reduced pressure.

The dispersing efficiency of the product of said example, as well as that of mixture B, are illustrated by the results reported in Table I.

EXAMPLE 6

Example 5 is repeated, but with the addition to the reaction mixture (before xylene removal) of 2.1 g of trimethylolpropane (i.e, $1.57\times10^{-2}$ mole). The mixture is then heated to reflux for 5 hours. Then xylene is removed by distillation under reduced pressure.

The obtained additive composition has a clearly higher dispersing efficiency than that of the product of example 5, as shown by the results summarized in Table I.

EXAMPLE 7 (comparative)

105.2 g of maleic anhydride (i.e, about 1.07 mole) are added to 2438 g of a mixture C containing 731 g of 100 Neutral oil and 1707 g of polyisobutenylsuccinimide obtained by reacting polyisobutenylsuccinic anhydride with a commercial mixture of tetraethylenepentamine (molar ratio "anhydride/TEPA"=1.8). The reaction mixture is heated for 3 hours at 80° C.

The dispersing effic:ency of the product of said example, as well as that of the initial mixture C, are shown by the results reported in Table I.

EXAMPLE 8

Example 7 is repeated, with the addition, after reaction of the maleic anhydride, of 44.3 g of pentaerythritol (about $32.6\times10^{-2}$ mole).

The so-obtained reaction mixture is heated for 5 hours at 190° C.

The resultant product has a nitroqen content of 1.74% by weight.

Its high dispersing efficiency is shown by the results reported in Table I. It is clearly higher than that of the product of example 7.

EXAMPLE 9 (comparative)

51.2 g of maleic anhydride (i.e, $52.2\times10^{-2}$ mole) are added to 2423 g of mixture C, as defined in example 7.

The reaction mixture is heated to 60° C. for 3 hours.

The dispersing efficiency of the product of this example is shown by the results reported in Table I.

EXAMPLE 10

Example 9 is repeated with the addition, after reaction of maleic anhydride, of 64.6 g of tris-hydroxymethylaminomethane (i.e, $53.4\times10^{-2}$ mole) and 2.66 g of zinc acetate. The mixture is then heated to 165° C. for 6 hours.

The obtained product has a high dispersing efficiency, clearly higher than that of the product of example 9, as shown by the results reported in Table I.

EXAMPLE 11

Example 9 is again repeated. After reaction of maleic anhydride, a portion of 1153 g is taken from the reaction mixture and 796 g of a solution containing 318 g of a trimethylolpropane polyisobutenylsuccinate (formed by reaction of polyisobutenylsuccinic anhydride with trimethylolpropane in a molar ratio "anhydride/trimethylolpropane" of 0.5) are added thereto. The reaction mixture is then heated to 160° C. for 7 hours.

The excellent dispersing efficiency of the obtained product is shown by the results reported in Table I. It has to be compared with that of the product of example 9.

EXAMPLE 12

Example 9 is again repeated, with the addition, after the reaction of maleic anhydride, of 70 g of a commercial mixture of tetraethylene pentamine. The reaction mixture is heated to 160° C. for 3 hours. The excellent dispersing efficiency of the obtained product, clearly higher than that of the product of example 9, is shown by the results reported in Table I.

TABLE I

| DISPERSING EFFICIENCY - "SPOT TEST" RESULTS | | | | | | | |
|---|---|---|---|---|---|---|---|
| | ACTIVE MATTERS | | | | +1% WATER | | |
| REFERENCES | % by weight | 20° C. | 10 mn 200° C. | 10 mn 250° C. | 20° C. | 1 mn 200° C. | 10 mn 100° C. |
| MIXTURE O (*) (a) (b) | 0 | 50 | 48 | 46 | 42 | 22 | 28 |
| MIXTURE A (*) | 3 (b) | 75 | 82 | 79 | 45 | 31 | 43 |
| | 3.7 | 67 | 68 | 68 | 69 | 53 | 55 |
| EXAMPLE | | | | | | | |
| 1 (*) | 3 | 68 | 76 | 76 | 73 | 71 | 79 |
| 2 | 3 | 64 | 70 | 68 | 72 | 70 | 74 |
| 3 (*) | 3.7 | 68 | 78 | 76 | 70 | 69 | 78 |
| 4 | 3.7 | 72 | 82 | 79 | 75 | 72 | 78 |
| MIXTURE B (*) | 3 | 66 | 75 | 74 | 38 | 40 | 51 |
| | 3.6 (b) | 75 | 84 | 84 | 44 | 47 | 59 |
| EXAMPLE | | | | | | | |
| 5 (*) | 3.7 | 65 | 77 | 76 | 66 | 64 | 70 |
| 6 | 3.6 | 70 | 78 | 78 | 72 | 72 | 74 |
| MIXTURE C (*) | 3.6 | 67 | 70 | 70 | 48 | 47 | 59 |
| EXAMPLE | | | | | | | |
| 7 (*) | 3 6 | 64 | 71 | 72 | 62 | 61 | 65 |
| 8 | 3 6 | 69 | 78 | 78 | 75 | 72 | 78 |
| 9 (*) | 3.6 | 63 | 70 | 70 | 62 | 60 | 64 |
| 10 | 3.6 | 69 | 75 | 75 | 71 | 75 | 77 |
| 11 | 3.6 | 69 | 76 | 75 | 72 | 76 | 76 |
| 12 | 3.6 | 70 | 76 | 76 | 72 | 75 | 78 |

(*) Comparative tests.
(a) Additive-containing oil without ashless dispersing additive.
(b) Reading after 24 hours.

TABLE II

| MOTOR TESTS RESULTS | | | |
|---|---|---|---|
| (1) V-D SEQUENCE | | | |
| DISPERSING AGENT | PISTON AVERAGE VARNISH | MOTOR AVERAGE VARNISH | AVERAGE MUDS |
| EXAMPLE 1* | 7.1 | 7.9 | 9.5 |
| EXAMPLE 2 | 8.5 | 9.2 | 9.6 |
| EXAMPLE 3* | 7.0 | 7.7 | 9.5 |
| EXAMPLE 4 | 8.6 | 9.3 | 9.6 |

| (2) MWM (B) | |
|---|---|
| DISPERSING AGENT | PISTON MARK |
| EXAMPLE 1* | 76 |
| EXAMPLE 2 | 83 |
| EXAMPLE 3* | 75 |
| EXAMPLE 4 | 84 |

*Comparative examples

What is claimed as the invention is:

1. An additive composition of improved dispersing effect in lubricating oils, consisting essentially of:

(1) the product resulting from the reaction (a) in a solvent, of at least one alkenylsuccinimide with at least one dianhydride of an aromatic polycarboxylic acid in a molar ratio from 0.25/1 to 20/1, at a temperature from 20° to 200° C.; or (2) the product resulting from the reaction (a) in a solvent, of at least one alkenylsucccinimide with at least one anhydride or dianhydride of a mono- or polycarboxylic, aliphatic, alicyclic or aromatic acid of low molecular weight, in a molar ratio from 0.25/1 to 20/1, at a temperature from 20° to 200° C. followed by the reaction (b) in a solvent of the resultant product with at least one organic compound having several hydroxy groups, amine groups or both, in a molar ratio of said organic compound to said anhydride or dianhydride from 0.25/1 to 4/1, at a temperature from 100° to 200° C.

2. A composition according to claim 1, wherein said alkenylsuccinimide involved in reaction (a) results from the previous reaction of at least one alkenylsuccinimide anhydride, whose alkenyl group has an average molecular weight by number from 500 to 5000, with at least one bi-primary polyamine of general formula :

$$\underset{NH_2}{H_2N}—CH_2—CH_2—(—NH—CH_2—CH_2—)—_m$$

wherein m is zero or an integer from 1 to 10, in a proportion from about 1 to 2 moles of alkenylsuccinic anhydride per mole of bi-primary polyamine.

3. A composition according to claim 1 consisting essentially of a product (1) resulting from the reaction (a) of at least one alkenylsuccinimide with pyromellitic dianhydride.

4. A composition according to claim 1 consisting essentially of a product (2) resulting from the reaction (a) of at least one alkenylsuccinimide with at least one anhydride or dianhydride having a molecular weight of at least 250, followed with the reaction (b) of the resultant product with at least one organic compound selected from aliphatic polyols, aliphatic aminoalcohols, polyethylenepolyamines, and esters of alkenylsuccinic acids and polyols.

5. A composition according to claim 4, wherein, in reaction (a), said anhydride or dianhydride is acetic anhydride, butyric anhydride, maleic anhydride, succinic anhydride or pyromellitic dianhydride and in that, in reaction (b)said organic compound is trimethylolpropane, pentaerythritol, dipentaerythritol, 2-amino 2-methyl propanol, tris-hydroxymethyl aminomethane or a polyisobutenylsuccinate of trimethylolpropane or pentaerythritol.

6. A composition according to claim 1, wherein, in the production of (1), in reaction (a), said alkylsuccinimide and said dianhydride is reacted in a solvent comprising at least one mineral oil.

7. A composition according to claim 6, wherein said solvent further comprises an aromatic solvent.

8. A composition according to claim 1, wherein, in the production of (2), the reactions (a) and (b) are preformed in a solvent comprising at least one mineral oil.

9. A composition according to claim 8, wherein said solvent further comprises an aromatic solvent.

10. A lubricating composition comprising a major proportion of a lubricating oil and a proportion from 0.1 to 20% by weight of an additive composition according to claim 1.

11. A composition according to claim 2, consisting essentially of a product (1) resulting from the reaction (a) of at least one alkenylsuccimide with pyromellitic dianhydride.

12. A lubricating composition comprising
a major proportion of a lubricating oil and a proportion from 0.1 to 20% by weight of an additive composition according to claim 2.

13. A lubricating composition comprising
a major proportion of a lubricating oil and a proportion from 0.1 to 20% by weight of an additive composition according to claim 3.

14. A lubricating composition comprising
a major proportion of a lubricating oil and a proportion from 0.1 to 20% by weight of an additive composition according to claim 4.

15. A lubricating composition comprising
a major proportion of a lubricating oil and a proportion from 0.1 to 20% by weight of an additive composition according to claim 5.

16. A lubricating composition comprising
a major proportion of a lubricating oil and a proportion from 0.1 to 20% by weight of an additive composition according to claim 6.

17. A lubricating composition comprising
a major proportion of a lubricating oil and a proportion from 0.1 to 20% by weight of an additive composition according to claim 7.

18. A lubricating composition comprising
a major proportion of a lubricating oil and a proportion from 0.1 to 20% by weight of an additive composition according to claim 8.

19. A lubricating composition comprising
a major proportion of a lubricating oil and a proportion from 0.1 to 20% by weight of an additive composition according to claim 9.

20. A additive composition of improved dispersing effect in lubricating oils, consisting essentially of:
(1) the product resulting from the reaction (a) of at least one alkenylsuccinimide with at least one dianhydride of an aromatic polycarboxylic acid in a molar ratio from 0.25/1 to 20/1, at a temperature from 20° to 200° C.; or
(2) the product resulting from the reaction (a) of at least one alkeny-lsuccoinimide with at least one anhydride or dianhydrid of a mono- or polycarboxylic, aliphatic, alicyclic or aromatic acid of low molecular weight, in a molar ratio from 0.25/1 to 20/1, at a temperature from 20° to 200° C. followed by the reaction (b) of the resultant product with at least one organic compound having several hydroxy groups, amine groups or both, in a molar ratio of said organic compound to said anhydride or dianhydrid from 0.25/1 to 4/1, at a temperature from 100° to 200° C.

21. A lubricating composition comprising
a major proportion of a lubricating oil and a proportion from 0.1 to 20% by weight of an additive composition according to claim 20.

* * * * *